US009359881B2

(12) United States Patent
DiSantis

(10) Patent No.: US 9,359,881 B2
(45) Date of Patent: Jun. 7, 2016

(54) PROCESSES AND SYSTEMS FOR DRILLING A BOREHOLE

(71) Applicant: MARATHON OIL COMPANY, Houston, TX (US)

(72) Inventor: Joseph R. DiSantis, Houston, TX (US)

(73) Assignee: Marathon Oil Company, Houston, TX (US)

( * ) Notice: Subject to any disclaimer, the term of this patent is extended or adjusted under 35 U.S.C. 154(b) by 691 days.

(21) Appl. No.: 13/706,932

(22) Filed: Dec. 6, 2012

(65) Prior Publication Data

US 2013/0146358 A1 Jun. 13, 2013

Related U.S. Application Data

(60) Provisional application No. 61/568,286, filed on Dec. 8, 2011.

(51) Int. Cl.
*E21B 44/00* (2006.01)
*E21B 7/00* (2006.01)
*E21B 44/02* (2006.01)

(52) U.S. Cl.
CPC . *E21B 44/00* (2013.01); *E21B 7/00* (2013.01); *E21B 44/02* (2013.01)

(58) Field of Classification Search
USPC ..... 175/27, 40, 39, 57, 24; 702/9
See application file for complete search history.

(56) References Cited

U.S. PATENT DOCUMENTS 4,914,591 A 4/1990 Warren et al.
5,713,422 A * 2/1998 Dhindsa ..... 175/27
6,206,108 B1 * 3/2001 MacDonald et al. ..... 175/24
6,424,919 B1 7/2002 Moran et al.
6,490,527 B1 12/2002 Utt
7,035,778 B2 4/2006 Goldman et al.
7,172,037 B2 2/2007 Dashevskiy et al.
7,243,735 B2 7/2007 Koederitz et al.

(Continued)

FOREIGN PATENT DOCUMENTS

WO 2013-063338 A2 5/2013
WO 2013/086370 A1 6/2013

OTHER PUBLICATIONS

Koederitz et al.; Real-Time Optimization of Drilling Parameters by Autonomous Empirical Methods; SPE/IADC 139849; 2011; pp. 1-16; Amsterdam, The Netherlands.

(Continued)

*Primary Examiner* — William P Neuder
*Assistant Examiner* — Ronald Runyan
(74) *Attorney, Agent, or Firm* — Jack E. Ebel

(57) ABSTRACT

Processes and systems for drilling a borehole wherein a gravitational energy term, a torsional energy term, a hydraulic energy term and a hydromechanical specific energy which is the sum thereof may be determined using real-time data and compared against corresponding setpoints. The hydraulic energy term may include a hydraulic energy reduction factor so as to account for the distance between the fluid nozzle of the drill bit and the rock and may include the kinematic viscosity of drilling fluid. One or more drilling parameters, such as weight on bit, revolutions per minute, drilling fluid flow rate, or combinations thereof, may be adjusted based upon such comparison to approximate the least amount of energy required to destroy and remove a given unit volume of rock. The setpoints may be changed manually or automatically at the direction of the user.

31 Claims, 5 Drawing Sheets

(56) References Cited

U.S. PATENT DOCUMENTS

| | | | |
|---|---|---|---|
| 7,357,196 | B2 | 4/2008 | Goldman et al. |
| 7,412,331 | B2 | 8/2008 | Calhoun et al. |
| 7,555,414 | B2 | 6/2009 | Calhoun et al. |
| 7,610,251 | B2 | 10/2009 | Shayegi et al. |
| 7,802,634 | B2 | 9/2010 | Boone |
| 7,823,655 | B2 | 11/2010 | Boone et al. |
| 7,857,047 | B2 | 12/2010 | Remmert et al. |
| 9,057,245 | B2 | 6/2015 | Wassell |
| 2002/0100615 | A1 | 8/2002 | Curlett et al. |
| 2004/0256152 | A1 | 12/2004 | Dashevskiy et al. |
| 2006/0162962 | A1 | 7/2006 | Koederitz et al. |
| 2007/0185696 | A1 | 8/2007 | Moran et al. |
| 2008/0156531 | A1 | 7/2008 | Boone et al. |
| 2008/0262810 | A1 | 10/2008 | Moran et al. |
| 2009/0076873 | A1 | 3/2009 | Johnson et al. |
| 2009/0090555 | A1 | 4/2009 | Boone et al. |
| 2009/0132458 | A1 | 5/2009 | Edwards et al. |
| 2009/0250264 | A1 | 10/2009 | Dupriest |
| 2010/0030527 | A1 | 2/2010 | Prasad et al. |
| 2010/0032165 | A1 | 2/2010 | Bailey et al. |
| 2010/0082256 | A1 | 4/2010 | Mauldin et al. |
| 2010/0243334 | A1 | 9/2010 | Dourfaye et al. |
| 2010/0252325 | A1 | 10/2010 | Porche |
| 2010/0259415 | A1 | 10/2010 | Strachan et al. |
| 2011/0155462 | A1 | 6/2011 | De Castel et al. |
| 2011/0290562 | A1 | 12/2011 | Standifird et al. |
| 2013/0105221 | A1 | 5/2013 | Wassell |

OTHER PUBLICATIONS

Ledgerwood et al.; Advanced Hydraulics Analysis Optimizes Performances of Roller Cone Drill Bits; IADC/SPE 59111; 2000; pp. 1-12; New Orleans, Louisiana.

Leine et al.; Stick-Slip Whirl Interaction in Drillstring Dynamics; conference in Rome, Italy; 2003; pp. 1-11.

Lim; Reservoir Properties Determination using Fuzzy Logic and Neural Networks from Well Data in Offshore Korea; Journal of Petroleum Science and Engineering 49; 2005; pp. 182-192; Elsevier B.V.; Republic of Korea.

MacPherson; presentation The Science of Stick-Slip; 2010; pp. 1-17; Baker Hughes Inc.

Mamdani et al.; An Experiment in Linguistic Synthesis with a Fuzzy Logic Controller; 1999; pp. 135-147; Academic Press; United Kingdom.

McMillan; Feedforward Control Enables Flexible, Sustainable Manufacturing; 2011; pp. 1-7; http://www.isa.org.

Mochizuki et al.; Real Time Optimization: Classification and Assessment; SPE 90213; 2004; pp. 1-14; Houston, Texas, USA.

Mohaghegh et al.; Design and Development of an Artificial Neural Network for Estimation of Formation Permeability; 1995; pp. 151-154; SPE Computer Applications.

Mohan; Tracking Drilling Efficiency Using Hydro-Mechanical Specific Energy; SPE/IADC 119421; 2009; pp. 1-12; Amsterdam, The Netherlands.

Nabaei et al.; Uncertainty Analysis in Unconfined Rock Compressive Strength Prediction; SPE 131719; 2010; pp. 1-15; Manama, Bahrain.

Nikravesh et al.; Mining and Fusion of Petroleum Data with Fuzzy Logic and Neural Network Agents; Journal of Petroleum Science and Engineering 29; 2001; pp. 221-238; Elsevier Science B.V.

Onyia; Relationships Between Formation Strength, Drilling Strength, and Electric Log Properties; SPE 18166; 1988; pp. 1-14; Society of Petroleum Engineers; Houston, Texas, USA.

Oyler et al.; Correlation of Sonic Travel Time to the Uniaxial Compressive Strength of U.S. Coal Measure Rocks; 2008; pp. 338-346; Conf 27; West Virginia, USA.

Pan et al.; Fuzzy Causal Probabilistic Networks—A New Ideal and Practical Inference Engine; 1998; pp. 1-8; Cooperative Research Centre for Sensor Signal and Information Processing; Australia.

Pessier et al.; Quantifying Common Drilling Problems with Mechanical Specific Energy and a Bit-Specific Coefficient of Sliding Friction; SPE 24584; 1992; pp. 373-388; Washington, D.C.

Rahimzadeh et al.; Comparison of the Penetration Rate Models Using Field Data for One of the Gas Fields in Persian Gulf Area; SPE 131253; 2010; pp. 1-11; Beijing, China.

Rampersad et al.; Drilling Optimization Using Drilling Data and Available Technology; SPE 27034; 1994; pp. 317-325; Buenos Aries, Argentina.

Rashidi et al.; Comparative Study Using Rock Energy and Drilling Strength Models; ARMA 10-254; 2010; pp. 1-7; American Rock Mechanics Association; Salt Lake City, Utah, USA.

Rashidi et al.; Real-Time Drill Bit Wear Prediction by Combing Rock Energy and Drilling Strength Concepts; SPE 117109; 2008; pp. 1-9; Abu Dhabi, United Arab Emirates.

Richard et al.; Influence of Bit-Rock Interaction on Stick-Slip Vibrations of PDC Bits; SPE 77616; 2002; pp. 1-12; San Antonio, Texas, USA.

Rommetveit et al.; Real-Time, 3D Visualization Drilling Supervision System Targets ECD, Downhole Pressure Control; 2008; pp. 1-4; Amsterdam, The Netherlands.

Rudat et al.; Development of an Innovation Model-Based Stick/Slip Control System; SPE/IADC 139996; 2011; pp. 1-12; Amsterdam, the Netherlands.

Shields; Standards Address the Challenges of Drilling Automation; SPE 143936; 2011; pp. 1-5; The Woodlands, Texas, USA.

Spaar et al.; Formation Compressive Strength Estimates for Predicting Drillability and PDC Bit Selection; SPE/IADC 29397; 1995; pp. 569-578; Amsterdam, The Netherlands.

Teale; The Concept of Specific Energy in Rock Drilling; Int. J. Rock Mech. Mining Sci; vol. 2; 1965; pp. 57-73; Pergamon Press; Great Britain.

Todorov et al.; Sonic Log Predictions Using Seismic Attributes; CREWES Research Report; vol. 9; 1997; pp. 39-1 to 39-12; 1 Hampson-Russel Software Services Ltd.

Uboldi et al.; Rock Strength Measurements on Cuttings as Input Data for Optimizing Drill Bit Selection; SPE 56441; 1999; pp. 1-9; Houston, Texas, USA.

Warren; Evaluation of Jet-Bit Pressure Losses; 1989; pp. 335-340; Society of Petroleum Engineers.

Warren; Penetration-Rate Performance of Roller-Cone Bits; 1987; pp. 9-18; Society of Petroleum Engineers.

Waughman et al.; Real-Time Specific Energy Monitoring Reveals Drilling Inefficiency and Enhances the Understanding of When to Pull Word PDC Bits; IADC/SPE 74520; 2002, pp. 1-14; Dallas, Texas, USA.

Wu et al.; Decoupling Stick-Slip and Whirl to Achieve Breakthrough in Drilling Performance; IADC/SPE 128767; 2010; pp. 1-13; New Orleans, Louisiana, USA.

Zhang et al.; Factors Determining Poisson's Ratio; CREWES Research Report; vol. 17; 2005; pp. 1-15.

Zhou et al.; New Approaches for Rock Strength Estimation from Geophysical Logs; 2005; pp. 151-164; Geological Society of Australia, Coal Geology Group; Australia.

Acaroglu et al.; A Fuzzy Logic Model to Predict Specific Energy Requirement for TBM Performance Prediction; ScienceDirect Tunnelling and Underground Space Technology 23; 2008; pp. 600-608; Elsevier Ltd.

Armenta; Identifying Inefficient Drilling Conditions Using Drilling-Specific Energy; SPE 116667; 2008; pp. 1-16; SPE International.

Ashena et al.; Bottom Hole Pressure Estimation Using Evolved Neural Networks by Real Coded Ant Colony Optimization and Genetic Algorithm; Journal of Petroleum Science and Engineering 77; 2011; pp. 375-385; Elsevier B. V.

Bonissone; Presentation Adaptive Neural Fuzzy Inference Systems (ANFIS): Analysis and Applications; 2002; pp. 1-41.

Caicedo et al.; Unique ROP Predictor Using Bit-specific Coefficient of Sliding Friction and Mechanical Efficiency as a Function of Confined Compressive Strength Impacts Drilling Performance; SPE/IADC 92576; 2005; pp. 1-19; Amsterdam, The Netherlands.

Cayeux et al.; Advanced Drilling Simulation Environment for Testing New Drilling Automation Techniques; IADC/SPE 150941; 2012; pp. 1-20; San Diego, California, USA.

Chang et al.; Empirical Relations Between Rock Strength and Physical Properties in Sedimentary Rocks; ScienceDirect Journal of Petroleum Science and Engineering 51; 2006; pp. 223-237; Elsevier Ltd.

(56) References Cited

OTHER PUBLICATIONS

Chapman et al.; Automated Closed-loop Drilling with ROP Optimization Algorithm Significantly Reduces Drilling Time and Improves Downhole Tool Reliability; IADC/SPE 151736; 2012; pp. 1-7; San Diego, California, USA.
Chrisman et al.; Information from a Downhole Dynamics Tool Provides Real-time Answers for Optimization While Drilling 10,000 ft Laterals in the Middle Bakken Formation of the Williston Basin; SPE 160121; 2012; pp. 1-12; San Antonio, Texas, USA.
Crawford et al.; Petrophysical Methodology for Predicting Compressive Strength in Siliciclastic "Sandstone-to-Shale" Rocks; ARMA 10-196; 2010; pp. 1-16; American Rock Mechanics Association; Salt Lake City, Utah, USA.
Curry et al.; Technical Limit Specific Energy—An Index to Facilitate Drilling Performance Evaluation; SPE/IADC 92318; 2005; pp. 1-8; Amsterdam, The Netherlands.
Dashevskiy et al.; Application of Neural Networks for Predictive Control in Drilling Dynamics; SPE 56442; 1999; pp. 1-9; Houston, Texas, USA.
Duan et al.; Stick-Slip Behavior of Torque Converter Clutch; 2005-01-2456; 2005; pp. 1-11; SAE International.
Dunlop et al.; Increased Rate of Penetration Through Automation; SPE/IADC 139897; 2011; pp. 1-11; Amsterdam, The Netherlands.
DuPriest et al.; Borehole Quality Design and Practices to Maximize Dill Rate Performance; SPE 134580; 2010; pp. 1-18; Florence, Italy.
DuPriest; Comprehensive Drill-Rate Management Process to Maximize Rate of Penetration; SPE 102210; 2006; pp. 1-9; San Antonio, Texas, USA.
DuPriest et al.; Maximizing Drill Rates with Real-Time Surveillance of Mechanical Specific Energy; SPE/IADC 92194; 2005; pp. 1-10; Amsterdam, The Netherlands.
DuPriest et al.; Maximizing ROP with Real-Time Analysis of Digital Data and MSE; IPTC 10607; 2005; pp. 1-8; International Petroleum Technology Conference; Doha, Qatar.
Florence et al.; Novel Automation Interface Improves Drilling Efficiency and Reliability; IADC/SPE 112637; 2008; pp. 1-5; Orlando, Florida, USA.
Florence et al.; Multiparameter Autodrilling Capabilities Provide Drilling/Economic Benefits; SPE/IADC 119965; 2009; pp. 1-10; Amsterdam, The Netherlands.
Goodman et al.; Volumetric Formation Mechanical Property Characterization for Drilling Engineering Modeling Applications Using the Rock Mechanics Algorithm (RMA); SPE/IADC 39266; 1997; pp. 1-16; Bahrain.
Grima et al.; Fuzzy Model for the Prediction of Unconfined Compressive Strength of Rock Samples; International Journal of Rock Mechanics and Mining Sciences 36; 1999; pp. 339-349; Elsevier Science Ltd.; The Netherlands.
Hammoutene et al.; FEA Modelled MSE/UCS Values Optimise PDC Design for Entire Hole Section; SPE 149372; 2012; pp. 1-11; Cairo, Egypt.
Holmes et al.; Generation Missing Logs B Techniques and Pitfalls; Search and Discovery Article #40107; 2003; pp. 1-5; AAPG Annual Meeting; Salt Lake City, Utah, USA.
Huang et al.; An Integrated Neural-Fuzzy-Genetic-Algorithm Using Hyper-Surface Membership Functions to Predict Permeability in Petroleum Reservoirs; Engineering Applications of Artificial Intelligence 14; 2001; pp. 15-21; Elsevier Science Ltd.; Australia.
Kaasa et al. Intelligent Estimation of Downhole Pressure Using a Simple Hydraulic Model; IADC/SPE 143097; 2011; pp. 1-13; Denver, Colorado, USA.
Kelessidis; Need for Better Knowledge of In-Situ Unconfined Compressive Strength of Rock (UCS) to Improve Rock Drillability Prediction; 2009; pp. 212-219; 3rd AMIREG International Conference: Assessing the Footprint of Resource Utilization and Hazardous Waste management; Athens, Greece.
Khaksar et al.; Rock Strength from Core to Logs: Where We Stand and Ways to Go; SPE 121972; 2009; pp. 1-16; Amsterdam, The Netherlands.

* cited by examiner

PROCESSES AND SYSTEMS FOR DRILLING A BOREHOLE

BACKGROUND OF THE INVENTION

1. Field of the Invention

The present invention relates to processes and systems for drilling a borehole, and more particularly, to processes and systems for drilling a borehole wherein the real-time specific drilling energies applied to the borehole are continually controlled to efficiently approximate and deliver the least amount of energy required to destroy and remove a given unit volume of rock without sacrificing rate of penetration.

2. Description of Related Art

In the production of fluid, from subterranean environs, a borehole may be drilled in a generally vertical, deviated or horizontal orientation so as to penetrate one or more subterranean locations of interest. Typically, a borehole may be drilled by using drill string which may be made up of tubulars secured together by any suitable means, such as mating threads, and a drill bit secured at or near one end of the drill string. Drilling operations may also include other equipment, for example hydraulic equipment, mud motors, rotary tables, whipstocks, as will be evident to the skilled artisan. Drilling fluid may be circulated via the drill string from pumps conjugate to the drilling rig through the drill bit. The drilling fluid may entrain and remove cuttings from rock face adjacent the drill bit and thereafter be circulated back to the drilling rig via the annulus between the drill string and borehole. After drilling, the borehole may be completed to permit production of fluid, such as hydrocarbons, from the subterranean environs.

As drilling a borehole is typically expensive, for example up to $500,000 per day, and time consuming, for example taking up to six months or longer to complete, increasing the efficiency of drilling a borehole to reduce cost and time to complete a drilling operation is important. Historically, drilling a borehole has proved to be difficult since an operator of the drilling rig typically does not have immediate access to, or the ability to make decisions based upon detailed rock mechanical properties and must rely on knowledge and experience to change those drilling parameters that are adjustable. Where a drilling operator has no previous experience in a given geological area, the operator must resort to trial and error to determine the most favorable settings for those adjustable drilling parameters. Processes have been proposed which utilize a traditional calculation of mechanical specific energy (MSE), which is the summed total of two quantities of energy delivered to the rock being drilled, torsional energy and gravitational energy, and manual adjustment of drilling parameters as a result of such calculation in an attempt to increase drilling efficiency. The original calculation developed by Teale, R. (1965) is as follows:

$$MSE=(W_b/A_b)+((120*\pi*RPM*T)/(A_b*ROP))$$

Where:

MSE=Mechanical Specific Energy (psi)

$W_b$=weight on bit (pounds)

$A_b$=surface area of the bit face, or borehole area ($in^2$)

RPM=revolutions per minute

T=torque (ft-lbf)

ROP=rate of penetration (ft/hr)

The basis of MSE is that there is a measurable and calculable quantity of energy required to destroy a unit volume of rock. Operationally, this energy is delivered to the rock by rotating (torsional energy) and applying weight to (gravitational energy) a drill bit via the drill string. Historically, drilling efficiency could then be gauged by comparing the compressive strength of the rock against the quantity of energy used to destroy it. More recently, real-time monitoring of rock properties and calculation of MSE based upon such real time properties of drilling operations has been proposed to increase drilling efficiency by monitoring and responding to fluctuations in real-time MSE. However, a need still exists to improve the understanding and efficiency of the process of drilling a borehole.

SUMMARY OF THE INVENTION

To achieve the foregoing and other objects, and in accordance with the purposes of the present invention, as embodied and broadly described herein, one characterization of the present invention is a process for drilling a borehole wherein real-time data may be obtained to determine a gravitational energy term, a torsional energy term, a hydraulic energy term and a value for hydromechanical specific energy which is the sum of the gravitational energy term, the torsional energy term and the hydraulic energy term and values for these energy terms may be determined. The hydromechanical specific energy based upon such real-time data may include a hydraulic energy reduction factor so as to account for the distance from the nozzle of the drill bit to rock and the kinematic viscosity of drilling fluid. Each of the gravitational energy term, the torsional energy term and the hydraulic energy term may be compared against a corresponding setpoint for each term. At least one drilling parameter may be adjusted based upon the comparison thereby approximating the least amount of energy required to destroy and remove a given unit volume of rock without sacrificing rate of penetration.

In another characterization of the present invention, a process is provided for drilling a borehole comprising obtaining real-time data necessary to determine a gravitational energy term, a torsional energy term, a hydraulic energy term and a hydromechanical specific energy which is the sum of the gravitational energy term, the torsional energy term and the hydraulic energy term and determining values for these energy terms. The determined values for each of the gravitational energy term, the torsional energy term and the hydraulic energy term may be compared against corresponding setpoints for each of the gravitational energy term, the torsional energy term and the hydraulic energy term. At least one drilling parameter may be automatically adjusted based upon the comparison to thereby reduce the amount of energy expended to destroy and remove a given unit volume of rock without sacrificing the rate of penetration.

In yet another characterization of the present invention, a process is provided for drilling a borehole comprising obtaining real-time data necessary to determine a gravitational energy term, a torsional energy term, a hydraulic energy term and a hydromechanical specific energy which is the sum of the gravitational energy term, the torsional energy term and the hydraulic energy term and determining values for these terms. The hydromechanical specific energy may be compared against a quantity of specific energy representing a compressive strength of subterranean rock encountered during drilling, an energy of extrusion for crushed rock particles, and drill string friction encountered in the borehole while drilling, and at least one drilling parameter may be adjusted based upon such comparison to approximate the least amount of energy required to destroy and remove a given unit volume of rock without sacrificing rate of penetration.

In a further characterization of the present invention, a system is provided for drilling a borehole. The system comprises a drilling rig comprising a drill string having a drill bit secured to one end thereof, draw works for raising and lowering the drill string, a top drive for rotating the drill string and at least one mud pump for circulating drilling fluid through the drill string and the drill bit. At least one programmable logic controller may be connected to and control at least one of the draw works, the top drive and the at least one mud pump. A control system may determine a gravitational energy term, a torsional energy term, a hydraulic energy term and a hydromechanical specific energy which is the sum of the gravitational energy term, the torsional energy term and the hydraulic energy term. The control system may compare each of the gravitational energy term, the torsional energy term and the hydraulic energy term against a corresponding setpoint for each term, and adjust at least one drilling parameter based upon the comparison to thereby approximate the least amount of energy required to destroy and remove a given unit volume of rock without sacrificing rate of penetration. A graphical interface may display at least the hydromechanical specific energy and permit a user to change the corresponding setpoint manually or automatically by means of the control system.

In a still further characterization of the present invention, a system is provided for drilling a subterranean borehole and comprises a drilling rig, at least one programmable logic controller, a control system and a graphical interface. The drilling rig comprises a drill string having a drill bit secured to one end thereof, draw works for raising and lowering the drill string, a top drive for rotating the drill string and at least one mud pump for circulating drilling fluid through the drill string and the drill bit. At least one programmable logic controller may be connected to and control at least one of the draw works, the top drive and at least one mud pump. The control system may determine a gravitational energy term, a torsional energy term, a hydraulic energy term and a value for hydromechanical specific energy which is the sum of the gravitational energy term, the torsional energy term and the hydraulic energy term. The value for hydromechanical specific energy may be compared against a quantity of specific energy representing the compressive strength of subterranean rock encountered during drilling, an energy of extrusion for crushed rock particles, and the drill string friction encountered in the borehole while drilling, and may adjust at least one drilling parameter based upon the comparison to thereby approximate the least amount of energy required to destroy and remove a given unit volume of rock without sacrificing rate of penetration. The graphical interface may display at least the hydromechanical specific energy and the quantity of energy representing the compressive strength of subterranean rock encountered during drilling, the energy of extrusion for crushed rock particles, and the drill string friction encountered in the borehole while drilling.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

The processes and systems of the present invention may be practiced and deployed in a borehole which may be formed by any suitable means, such as by a rotary drill string, as will be evident to a skilled artisan. As used throughout this description, the term "borehole" is synonymous with wellbore and means the open hole or uncased portion of a subterranean well including the rock face which bounds the drilled hole. A "drill string" may be made up of tubulars secured together by any suitable means, such as mating threads, and a drill bit secured at or near one end of the drill string. The borehole may extend from the surface of the earth, including land, a sea bed or ocean platform, and may penetrate one or more environs of interest. As used throughout this description, the terms "environ" and "environs" refers to one or more subterranean areas, zones, horizons and/or formations that may contain hydrocarbons. The borehole may have any suitable subterranean configuration, such as generally vertical, generally deviated, generally horizontal, or combinations thereof, as will be evident to a skilled artisan. Typically, a drilling rig has a rig control system which governs a network of programmable logic controllers allowing a drilling operator to control the draw works, the top drive and the mud pumps on the drilling rig among other equipment. The draw works of a drilling rig is a machine which primarily reels the drill sting in and out of the borehole and thereby controls the weight on bit. The top drive is a device that turns the drill string and thereby controls revolutions per minute ("RPM") thereof. The mud pump circulates drilling fluid under high pressure down the drill string and up the annulus between the drill string and the borehole to the drilling rig and thereby controls the drilling fluid circulation rate.

Figure 1:
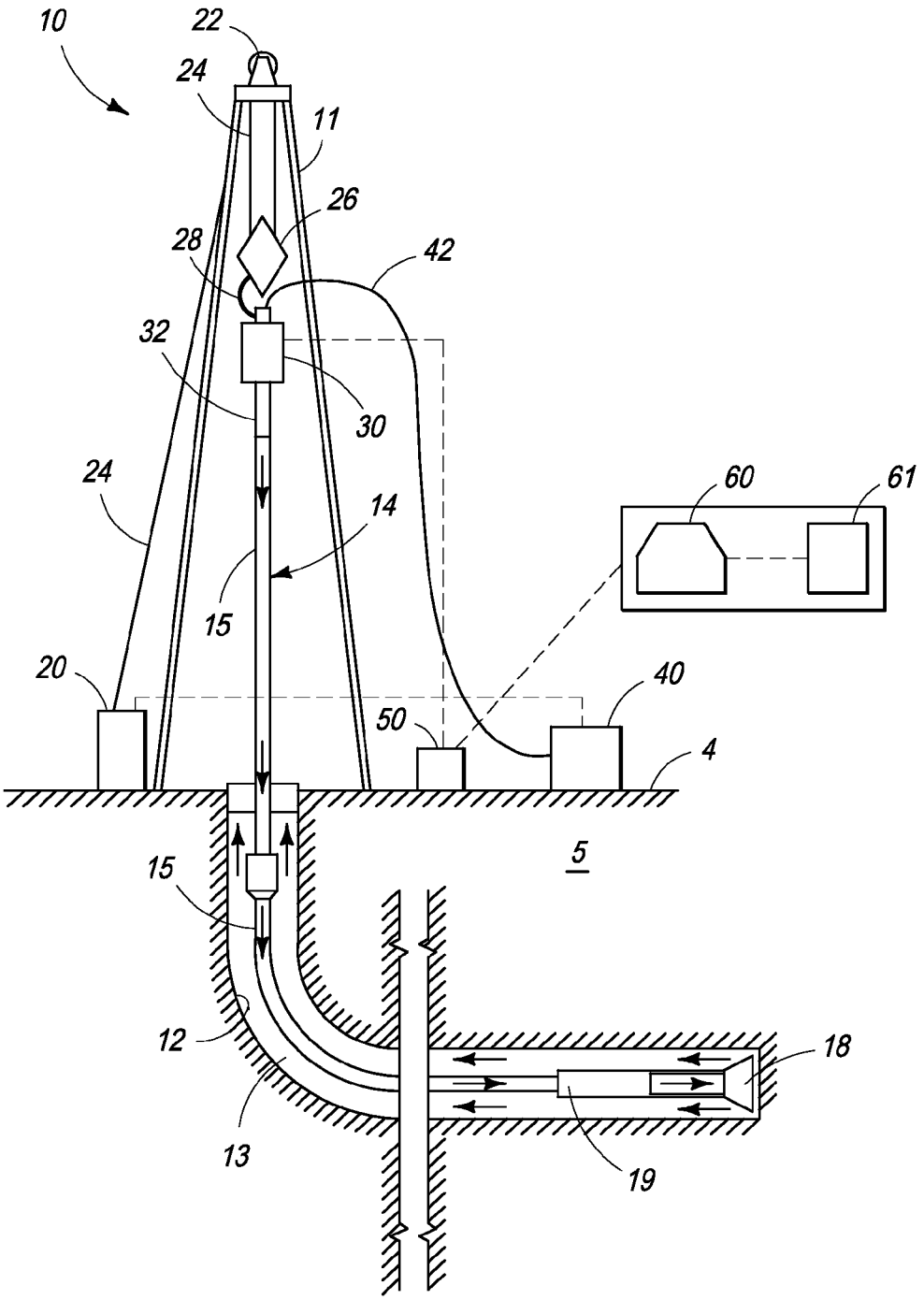
FIG. 1 is a schematic of a drilling rig as deployed to drill a subterranean borehole.

A drilling rig that may be typically comprised of component parts may be permanent or mobile and may be land or marine based is generally illustrated in FIG. 1. The components of a drilling rig 10 may comprise a derrick 11 through which a drill string 14 may be lowered by the draw works 20 and rotated by top drive 30 to form a borehole 12 in the earth 5. Draw works 20 may be connected to top drive 30 by any suitable means, such as drilling lines 24, a crown block 22, traveling block 26 and connector 28, while the top drive 30 may be connected to drill string 14 by any suitable means as will be evident to a skilled artisan, for example a drive shaft 32. Drill string 14 may be made up of tubulars 15 secured together by any suitable means as will be evident by a skilled artisan, for example by mating, threaded male and female ends, and has a suitable drill bit 18 secured to one end thereof. A bottom hole assembly 19 may also be included near one end of the drill string and may include measurement while drilling (MWD) instrumentation, logging while drilling (LWD) instrumentation, or both to provide real time down hole measurements to the operators of the drilling rig. Such MWD and LWD instrumentation may measure gamma ray radiation, sonic velocities, porosity, density, resistivity, borehole azimuth, borehole inclination, pressures, temperature, weight on bit, revolutions per unit time, bending moments, vibration, shock and torque and may include a suitable means of communication to tools used to adjust borehole trajectory tools positioned within the bottom hole assembly. The measured results may be stored in the instrumentation's physical memory and also may be transmitted to surface in real time using mud pulse telemetry through the drilling mud or other advanced telemetry technology such as electromagnetic (EM) frequency or acoustic communications or wired drill string. Drilling mud may be pumped from the surface by means of mud pump(s) 40 via line 42 and through the drill string 14 to circulate rock cuttings to the surface 4 via the annulus 13 formed between the borehole 12 and drill string 14 (as indicated by the arrows in FIG. 1).

In accordance with the present invention, an advanced control system 60 may be provided at or near the rig which may be in operational communication with the rig's existing network of programmable logic controllers (PLCs) 50 governing action of draw works 20, top drive 30 and mud pump(s) 40 by any suitable means, for example by direct electrical wiring or electromagnetic signals, so as to control each of these pieces of equipment among others on the drilling rig. Advanced control system 60 may include proportional integral derivative (PID) loop control algorithms which may function as described below. Measurements from the MWD and/or LWD instrumentation in the bottom hole assembly 19 as well as at the surface by a data acquisition system (not illustrated) on a drilling rig are continually input into the advanced control system 60 which performs a real time calculation of hydromechanical specific energy (HMSE) and uses PID loop control algorithms to continually iterate adjustments of a manipulated variable, for example WOB, in order to drive a process variable, for example gravitational energy term G, towards a setpoint for that process variable until such point in time when the difference, or error, between the process variable and its setpoint is equal to zero. At that point, no further adjustment to the manipulated variable is required until and if the process variable begins to deviate from its setpoint. A variety of operational and/or environmental factors may cause the process variable to deviate from its setpoint, for example drilling through rock formations of different compressive strengths or vibrations in the drill string leaching energy out of the system, etc. Advanced control system 60 is connected to a graphical, visual interface 61, such as a liquid crystal display, to permit operating personnel on the drilling rig 10 to view in real time HMSE, manipulated variables, process variables and other information as such personnel may require.

In general, the embodiments of the present invention are based upon improving the efficiency of drilling a borehole by using a unique calculation and processes for governing and controlling the real time specific drilling energies applied to a borehole during drilling operations in response to such calculation so as to efficiently approximate and deliver the least amount of energy required to destroy and remove a given unit volume of rock without sacrificing rate of penetration.

One embodiment of the present invention is directed to a method of improving the efficiency of drilling a borehole in response to real time calculation of hydromechanical specific energy (HMSE) which includes the hydraulic energy delivered to the face of the borehole adjacent the drill bit by the drilling fluid, in addition to unique calculations of the traditional torsional and gravitational terms of the MSE equation. HMSE is the summed total of three quantities of energy delivered to the rock being drilled: gravitational energy, torsional energy, and hydraulic energy. The HMSE calculation employed in the present invention incorporates the hydraulic energy delivered to the rock face underneath the bit along with the gravitational energy imposed by the weight of the drill string and the torsional energy imposed by rotating the drill string, thereby providing a more accurate quantification of the energy expended to drill a borehole by destroying rock (overcoming the rock's compressive strength), removing rock (overcoming the crushed rock particle energy of extrusion) and annulling frictional resistance (between the drill string and the borehole), than previous specific energy calculations.

HMSE may be calculated in accordance with the following general equation:

$$HSME = G\ \text{(gravitational term)} + T\ \text{(torsional term)} + H\ \text{(hydraulic term)}$$

$$= \frac{4(W_b - \beta F_i)}{\pi * D_b^2} + \frac{480 * (RPM + m_r * Q) * (t + m_t * dP)}{D_b^2 * ROP} + \alpha * \frac{4616 * P_b * Q}{\pi * D_b^2 * ROP}$$

Expanding individual energy terms G, T and H into independent variables yields:

$$G = \frac{4(W_b - \beta F_i)}{\pi * D_b^2} = \frac{4\left(W_b - \left(\frac{1 - \left(1022.5\frac{D_b^2 - D_p^2}{\sum(D_n^2)}\right)^{-k}}{r * e^{\left(\frac{0.01294 * \mu}{MW}\right)}}\cos(\theta)\right) * \left(MW * \frac{417.2 * Q^2}{\sum(D_n^2)}{1930}\right)\right)}{\pi * D_b^2}$$

$$T = \frac{480(RPM + m_r * Q) * (t + m_t * dP)}{D_b^2 * ROP}$$

$$H = \alpha * \frac{4616 * P_b * Q}{\pi * D_b^2 * ROP} = \left(\frac{1 - \left(1022.5\frac{D_b^2 - D_p^2}{\sum(D_n^2)}\right)^{-k}}{r * e^{\left(\frac{0.01294 * \mu}{MW}\right)}}\right) * \frac{0.425 * MW * Q^3}{\pi * D_b^2 * \left(\frac{\sum(D_n^2)}{1303.8}\right)^2 * ROP}$$

Thereby resulting in an expanded HMSE calculation:

$$\frac{4\left(W_b - \left(\frac{1 - \left(1022.5\frac{D_b^2 - D_p^2}{\sum(D_n^2)}\right)^{-k}}{r * e^{\left(\frac{0.01294 * \mu}{MW}\right)}}\cos(\theta)\right) * \left(MW * \frac{417.2 * Q^2}{\sum(D_n^2)}{1930}\right)\right)}{\pi * D_b^2} + \frac{480 * (RPM + m_r * Q) * (t + m_t * dP)}{D_b^2 * ROP} + \left(\frac{1 - \left(1022.5\frac{D_b^2 - D_p^2}{\sum(D_n^2)}\right)^{-k}}{r * e^{\left(\frac{0.01294 * \mu}{MW}\right)}}\right) * \frac{0.425 * MW * Q^3}{\pi * D_b^2 * \left(\frac{\sum(D_n^2)}{1303.8}\right)^2 * ROP}$$

Wherein:

$D_b$=drill bit diameter (inches)

$D_p$=drill Pipe diameter (inches)

$D_n$=nozzle diameter ($32^{nd}$ inch)

$F_i$=fluid jet impact force (lbs)

K=modeled constant (0.122, unless otherwise modeled for a specific bit)

$m_r$=mud motor rotary factor (RPM/gal)

$m_t$=mud motor torque factor ($in^3$)

n=quantity of bit nozzles $P_b$=pressure drop across drill bit (psi)

Q=surface or downhole drilling fluid circulation rate (gpm)

r=distance from bit nozzle to formation (inches)
ROP=surface or downhole rate of penetration (ft/hr)
RPM=surface or downhole revolutions per minute
t=surface or downhole torque (ft lbs)
G=gravitational energy term (psi)
T=torsional energy term (psi)
H=hydraulic energy term (psi)
$W_b$=surface or downhole weight on bit (lbs)
α=hydraulic energy reduction factor (unitless)
β=impact force reduction factor (unitless)
θ=cutting angle of the fluid jet (°)
μ=dynamic viscosity of the drilling fluid (cP)

The magnitude of the hydraulic term is reduced circumstantially by a factor α, which may be calculated in accordance with the following equation:

$$\alpha = \frac{1 - A_v^{-k}}{r * e^{(v)}}$$

Wherein:
Av=fluid velocity ratio $$\left(\frac{V_n}{V_f}\text{ratio}\right)$$

$V_n$=bit specific jet velocity (ft/s)
$V_f$=annular fluid velocity (ft/s)
e=Euler's mathematical constant ~2.71828 . . .
v=kinematic viscosity of the drilling fluid ($in^2$/sec)

Incorporation of the hydraulic energy reduction factor α into the calculation of the hydraulic term accounts for the kinematic viscosity of the drilling fluid, commonly thought of as the diffusivity of momentum, which is a crucial parameter to consider when analyzing an environment as wildly turbulent as the bottom of a borehole during drilling, as it either enables or impedes the ability of a given drilling fluid to do work. If a drilling fluid exhibits the characteristic of readily diffusing its momentum (high kinematic viscosity), that fluid is using more energy to overcome its internal shearing resistance in order to flow, thereby reducing the energy available to clear away extruded rock cuttings from underneath the bit. In addition, the amount of hydraulic energy underneath the bit is inversely proportional to the distance from the nozzle, and will decrease in magnitude as fluid propagates from the nozzle to the rock formation. Contrasted to the common inverse square law model based on radiation expanding as a spherical surface, $$\left(\frac{1}{4\pi r^2}\right),$$

in the case of hydraulic energy emanating from a drill bit via a fluid jet, it is preferred to consider only the one-dimensional (linear) direction of the jet velocity vector in three dimensional space and model the energy reduction accordingly, $$\frac{1}{r}.$$

The skilled artisan will also recognize that entrained fluid flow in directions opposing the jet velocity vector which has been deflected off of the rock may further increase the magnitude of energy reduction.

The magnitude of the gravitational term is reduced by the drilling fluid jet impact force $F_i$. Given that the fluid jet impact force is a vector quantity, the directional component thereof that is parallel with the direction of borehole extension varies relative to the cosine of the cutting angle of the fluid jet. The skilled artisan will also recognize that if more than one nozzle is present on a drill bit (i.e.—multiple fluid jets), then the jet velocity resultant vector would be used to model the system. The impact force reduction factor 13 may be calculated in accordance with the following equation:

$$\beta = \alpha * \cos\theta = \frac{1 - A_v^{-k}}{r * e^{v}} \cos\theta$$

Wherein:
⊖=cutting angle of the fluid jet or resultant vector (°)

As current drilling operations may include the use of a down hole hydraulically driven mud-motor, the torsional term may be modified accordingly to account for the extra revolutions per unit of time that are realized by the bit when fluid is pumped through the motor in addition to any extra torque from the motor. If no mud motor is used, then the mud-motor factors for rotary and torque, $m_r$ and $m_t$ respectively, will simply be set equal to zero within the torsional term T.

Figure 2:
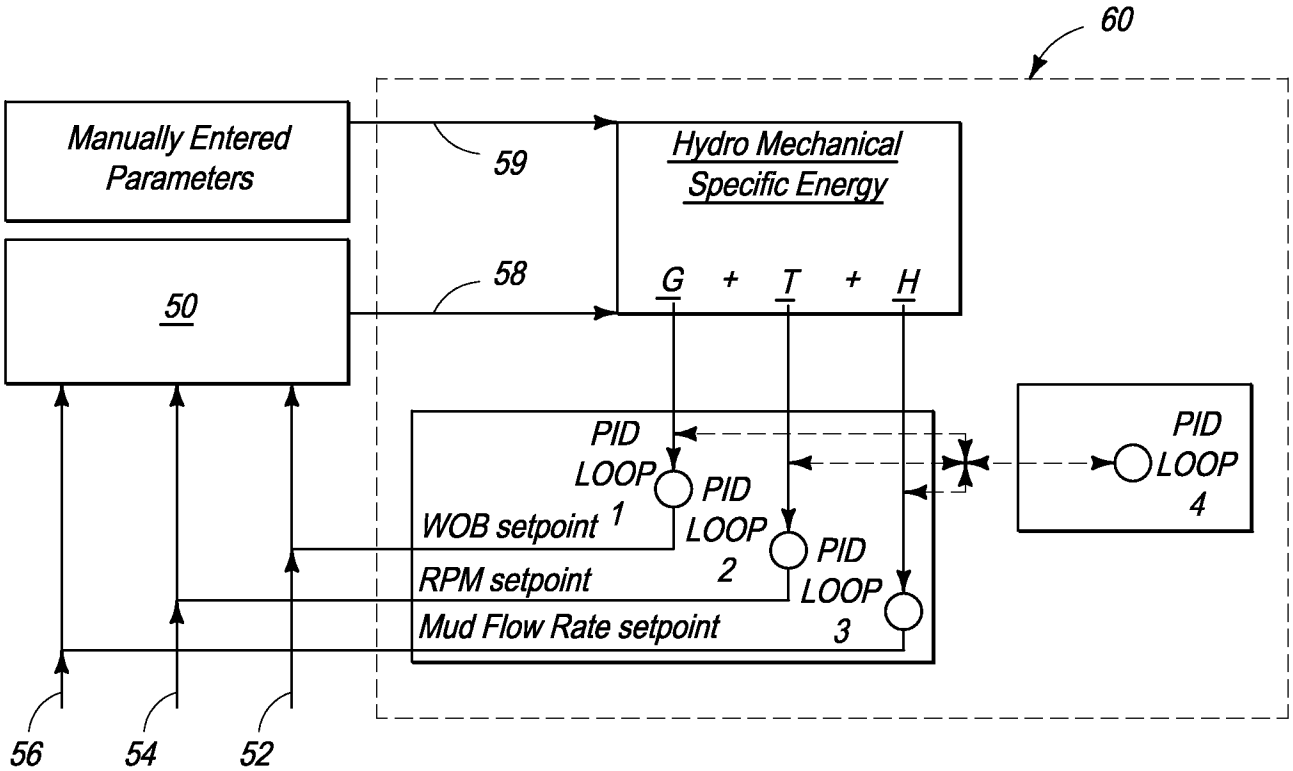
FIG. 2 is a block flow diagram of one embodiment of the processes of the present invention.

In accordance with an embodiment of the processes and systems of the present invention illustrated in FIG. 2, a continual analysis of HMSE may be conducted during drilling operations using real-time data to calculate each term of HMSE which is continually appropriately displayed, for example graphically, on an appropriate visual interface 61, such as a liquid crystal display, which may be viewed by the operating personnel on drilling rig 10. Real time drilling data, such as Torque, RPM, WOB, ROP, and Q, may be measured at the surface by the data acquisition system on a drilling rig or obtained downhole by various technologies, for example by measurement while drilling (MWD) instrumentation and/or logging while drilling (LWD) instrumentation in the bottom hole assembly 19, and transmitted to the surface by various telemetries, for example mud pulse, electromagnetic, acoustic or wired drill string and entered into an advanced control system 60 by any suitable means 58 of date transmission, for example Ethernet cable or wireless data transmission systems. Other parameters, such as drill pipe diameter, drill bit diameter, number of nozzles on the drilling bit, etc. may also be entered into the advanced control system 60 by any suitable means 59 of data transmission, for example Ethernet cable or wireless data transmission systems. The gravitational term G, the torsional term T and the hydraulic term H may then be calculated using such real-time data and manually entered data and summed to determine HMSE which may also be continually displayed on the visual interface. In one aspect of the embodiment depicted in FIG. 2, the processes and systems of the present invention may be configured for operation in a manual mode. Typically, the manual mode may be selected by a user, for example the operator of a drilling rig, via any suitable means, for example a graphical user interface 61, especially in instances where no offset well data or no meaningful offset well data is available. In the manual mode of operation, one or more operating personnel associated with the drilling rig may actuate the draw works 20, top drive 30, mud pump(s) 40 or combinations thereof by manually adjusting the output signals 52, 54, 56 or combinations thereof from PID loops 1, 2 or 3, respectively, which subsequently passes setpoints into the PLC network 50 of the drilling rig based upon such personnel's observation of the display of HMSE and the individual terms G, T and H thereof in an effort to reduce HMSE or any combination of the individual terms G, T and H so as to deliver the least amount of energy required to destroy and remove a given unit volume of rock. In manual mode, the PID loops illustrated in FIG. 2, in conjunction with the graphical user interface, serve to continually display the values of HMSE calculated in accordance with the present invention and the individual terms thereof as process variables (PV) to the operating personnel, while allowing manual adjustment of output signals from the PID loops 52, 54, 56 as a means of adjusting drilling parameters, i.e. WOB, RPM and mud flow rate, by controlling the draw works 20, top drive 30, mud pump(s) 40 or combinations thereof in response to such display. Further, pattern recognition algorithms deployed via any suitable means, for example fuzzy logic and/or one or more artificial neural networks, may be used to identify drilling inefficiencies or dysfunctions and display recommended adjustments to the HMSE term values to the operating personnel on the drilling rig. Based upon these recommendations and the experience of the operator, adjustments to the gravitational, torsional and hydraulic energy terms can be made by manually changing the outputs from PID loops 1, 2 or 3, respectively, which subsequently passes setpoints 52, 54, 56 for WOB, RPM, mud flow rate or combinations thereof into the programmable logic control network of the drilling rig control system 50. Such process of using HMSE and the individual terms G, T and H thereof to mitigate drilling dysfunctions may be continually practiced during drilling of the well.

Figure 3:
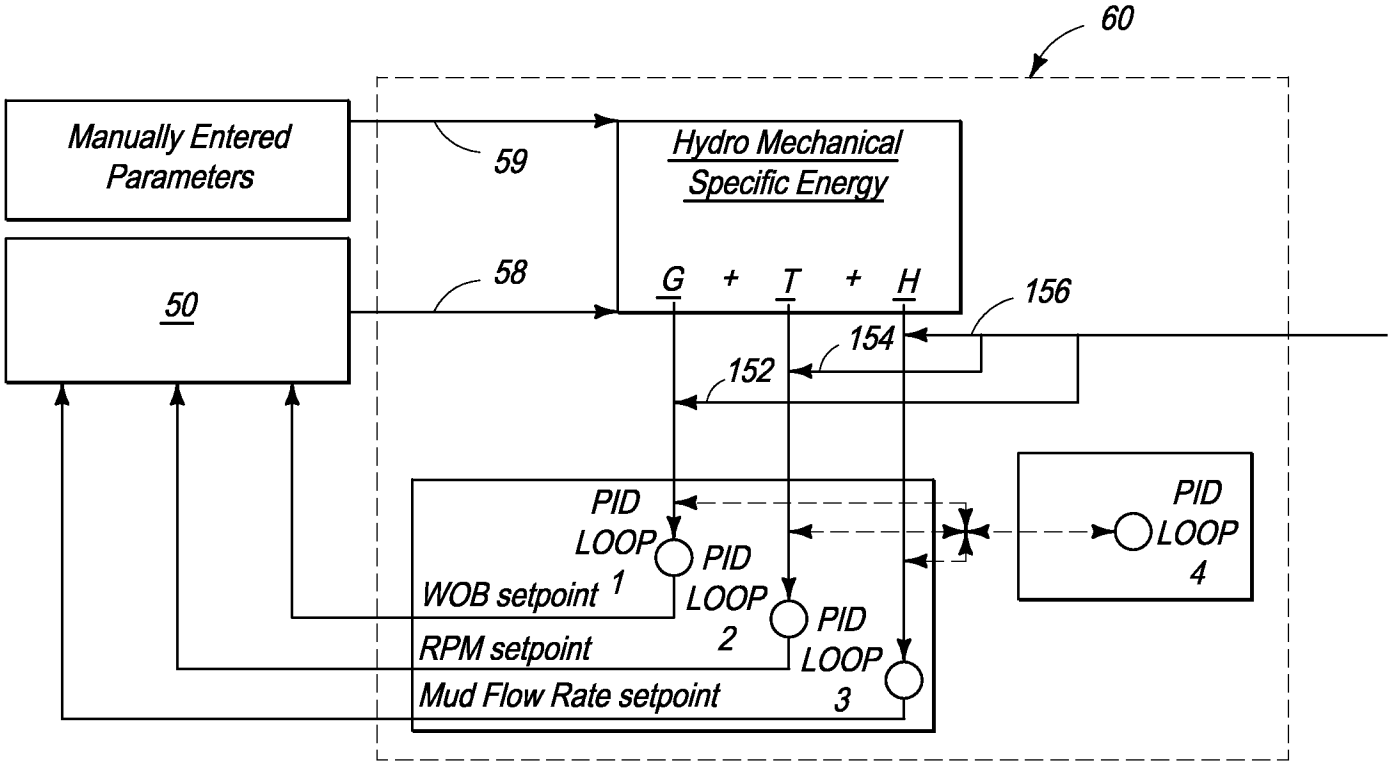
FIG. 3 is a block flow diagram of another embodiment of the processes of the present invention.

In another embodiment of the processes and systems of the present invention illustrated in FIG. 3 where no offset well data or no meaningful offset well data is available, the system and process may be operated in an automatic mode wherein pattern recognition algorithms deployed via any suitable means, for example fuzzy logic and/or one or more artificial neural networks, may be used to identify drilling inefficiencies or dysfunctions, and PID control loops are again used to display the values of HMSE and the individual terms thereof calculated in accordance with the present invention to the operating personnel on the drilling rig. However, in the automatic mode of operation, the PID control loops may be utilized subsequent to the calculation of each HMSE term in a manner to autonomously govern the action of individual drilling rig components in real time, for example the draw works by way of weight on bit setpoint manipulation, the top drive by way of RPM setpoint manipulation and the mud pumps by way of fluid flow rate setpoint manipulation, which in turn affect the real time magnitude of HMSE and the terms thereof, thereby giving rise to a real time hydromechanical specific energy control loop. In this embodiment, operating personnel may initially utilize the advanced control system's visual interface 61 to manually impose setpoints 152, 154, 156 for each term G, T and H which in turn causes the respective PID loop to adjust individual drilling parameters so as to iteratively drive each term G, T and H toward the setpoint within certain constraints related to equipment or operational limitations that may be preset and subsequently adjusted.

For example, with respect to the gravitational energy G PID loop 1, the operator may impose a setpoint 152 for G (process variable) via the advanced control system's visual interface 61 resulting in the PID loop's manipulation of the WOB parameter as an output signal to the existing PLC network 50 on the drilling rig in an attempt to continually drive the process variable, G, equal to the setpoint.

Regarding the torsional energy PID loop 2, the operator may, for example, impose a setpoint 154 for T (process variable) via the advanced control system's visual interface 61 resulting in the PID loop's manipulation of the RPM parameter as an output signal to the existing PLC network 50 on the drilling rig in an attempt to continually drive the process variable, T, equal to the setpoint.

Regarding the hydraulic energy PID loop 3, the operator may, for example, impose a setpoint 156 for H (process variable) via the advanced control system's visual interface 61 resulting in the PID loop's manipulation of the fluid flow rate parameter as an output signal to the existing PLC network 50 on the drilling rig in an attempt to continually drive the process variable, H, equal to the setpoint.

In this embodiment of the processes and systems of the present invention illustrated in FIG. 3, the automatic mode of operation allows PID loop action to maintain efficiency of the drilling operation during times when operational and/or environmental factors, such as varying rock strengths or vibrations in the drill string leaching energy out of the system, are influential, by automatically changing the outputs from PID loops 1, 2 or 3, respectively, which subsequently passes setpoints for WOB, RPM, mud flow rate or combinations thereof into the programmable logic control network 50 of the drilling rig.

Initial setpoints for G, T and H may be derived using fuzzy logic and/or one or more artificial neural networks using real time drilling conditions as inputs, for example, depth, rock type, fluid type, and borehole properties, such as inclination and azimuth. Alternatively, initial setpoints for G, T and H may be derived using expertise of experienced drilling personnel with an understanding of preferred ratios of G:T:H that will achieve efficient drilling.

An operator may impose setpoints 152, 154 and 156 on all of the PID loops 1, 2 and 3, respectively, in a manner as described above, on any combination of two of these PID loops, or on only one of these PID loops 1-3. In those instances where the setpoints 152, 154 or 156 are not imposed on a PID loop in a manner as described above with respect to FIG. 2, outputs from those PID loops where setpoints have not been imposed may be manually adjusted so as to pass setpoints 52, 54 or 56 into the programmable logic control network of the drilling rig control system 50 in a manner as described above with respect to FIG. 2. Accordingly, PID loops 1-3 may be operated in accordance with the process and systems of FIG. 2, FIG. 3 or combinations thereof.

In still another embodiment of the present invention, HMSE determined in accordance with the present invention may not only improve the accuracy of the calculation of the energy needed to drill a borehole over previous specific energy calculations, but more importantly, may allow for an energy-balance to be performed around the borehole where sufficient offset well data is available. In real time, the specific energy put into the borehole as a result of the drilling operation may be set equal to the quantity of specific energy related to the rock's compressive strength (CCS) in addition to the crushed rock particle energy of extrusion ($E_e$) in addition to the energy required to overcome dynamic frictional forces in the borehole ($E_f$), giving [$HMSE=CCS+E_e+E_f$] as the process model and governing equation. The quantity [$CCS+E_e+E_f$] should be thought of as the potential specific energy or resistive specific energy of the environ to be overcome by the kinetic specific energy or hydromechanical specific energy of the drilling operation in constructing a borehole within said environ.

Performing the energy-balance in real time allows for the governing equation to be rearranged and solved for adjustable drilling parameters, such as WOB, RPM, Q or combinations thereof.

Figure 4:
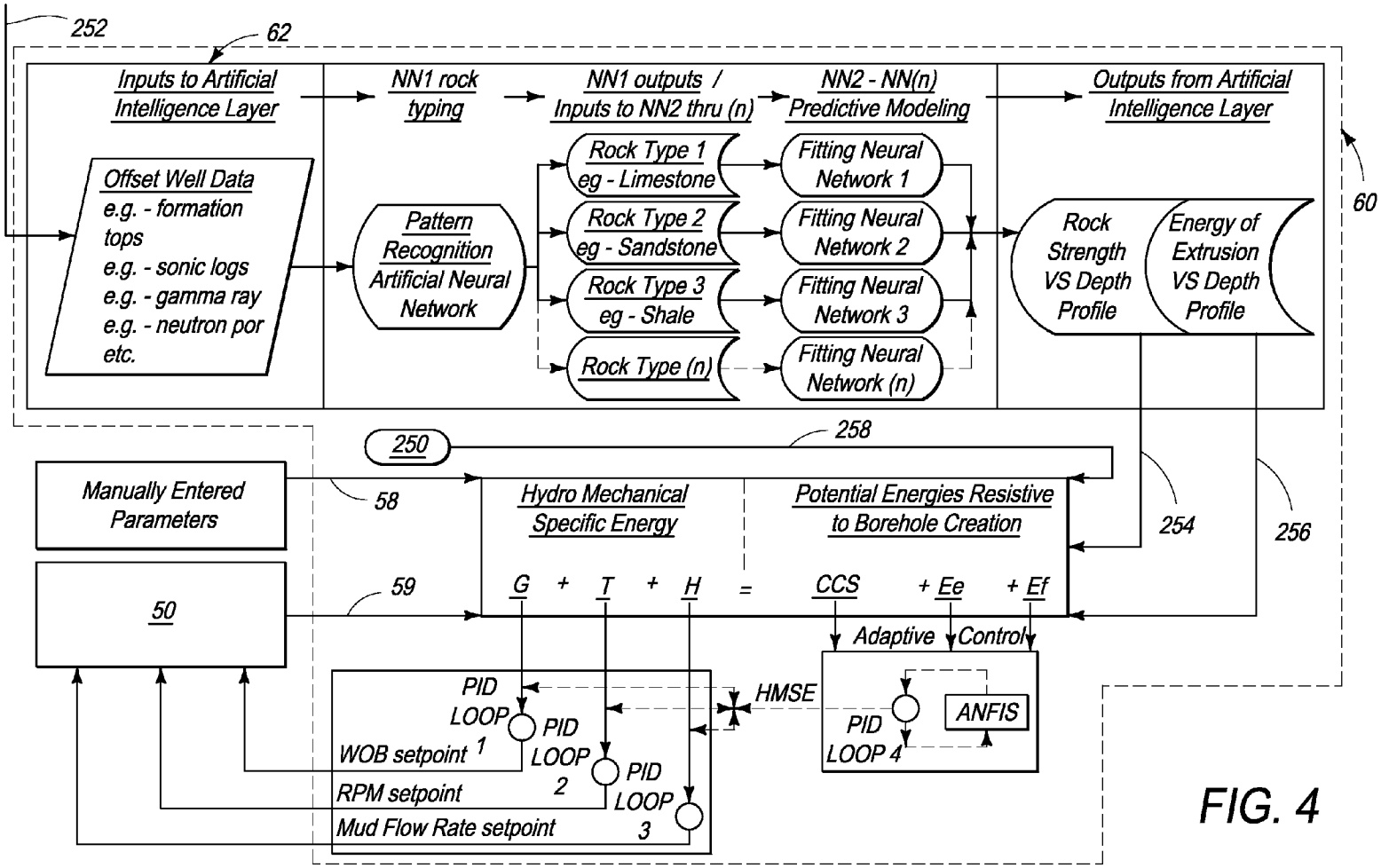
FIG. 4 is a block flow diagram of still another embodiment of the processes of the present invention.

Accordingly, as illustrated in FIG. 4, the system and process may be operated in a cascade mode where sufficient offset well data exists to input actual well data 252, modeled well data 252 or combinations thereof 252 via the advanced control system's visual interface 61 into an artificial intelligence layer 62 within the advanced control system 60 which may use fuzzy logic and/or one or more artificial neural networks that may predictively determine the type of subterranean rock and compressive strength (CCS) of the subterranean rock to be encountered during drilling in addition to the crushed rock particle energy of extrusion ($E_e$). Based upon pattern recognition and predictive modeling, the artificial intelligence layer may output a rock strength vs. depth profile of the borehole to be drilled 254 and an energy of extrusion vs. depth profile of the borehole to be drilled 256 such that the rock's compressive strength and the energy of extrusion may be continually input into a real time energy balance against the HMSE during drilling. In addition to the CCS and $E_e$ inputs to the energy balance, as illustrated by FIG. 4, a drill string friction model 250 may be used to generate yet another quantity of energy ($E_s$) as an input via means 258 to the energy balance. The drill string friction model may be based on one or more real time drilling data parameters 58, for example depth, RPM, inclination, dog leg severity, etc., one or more manually entered parameters 59, for example drilling fluid weight, drilling fluid type, drilling fluid lubricity, etc., or combinations thereof, so as to produce a value representing the resistive energy associated with dynamic frictional forces between the drill string and the borehole while drilling. Accounting for all said energies yields the energy balance as $HMSE=[G+T+H]=[CCS+E_e+E_f]$.

An advantage of utilizing PID algorithms to control a process may be that several PID controllers can be arranged together in such a way that yields better dynamic performance, via cascaded PID control. In a cascade control scheme, PID loops may be arranged with one master loop controlling the setpoint of one or more other slave PID loops. The master controller acts as the outer loop controller, which controls the primary parameter, such as HMSE. The other slave controllers act as inner loop controllers, which read the outputs of outer loop controller as setpoints, usually controlling more rapidly changing parameters, such as gravitational, torsional and hydraulic energies. Typically, the cascade mode may be selected by a user via any suitable means, such as a graphical user interface 61. In this embodiment, the respective PID loops 1, 2 and 3 may function in a manner similar to that described with respect to automatic mode of FIG. 3, i.e. to iteratively drive the process variable (PV) for each term G, T and H toward their corresponding setpoints within preset and adjustable constraints, but now may operate as slave PID loops in a master-slave control loop scheme to the master PID control loop 4. The PV of loop 4 is HMSE, allowing the PID control algorithm of loop 4 to iteratively drive HMSE toward a setpoint within preset and adjustable constraints by continually adjusting its output signals to loops 1, 2 and 3, which are actually energy term setpoints for G, T and H, respectively. Additionally, an adaptive control module 270 which may be comprised of an adaptive neuro-fuzzy inference system (ANFIS) may be configured to perform pattern recognition analyses using real-time trends of HMSE and terms thereof along with rock properties as inputs. The ANFIS may function to manage or maintain specific ratios between individual energy term values and/or specific ratios between one or more individual energy terms and the total HMSE, thereby controlling one or more energy terms partial contribution to the total HMSE. For example, there may be a situation where the system is utilized to focus on optimizing the G:H ratio when hole-cleaning may be critical, or alternatively, there may be a situation where the system is utilized to focus on the G:T ratio when mitigation of vibrational dysfunctions, such as stick slip, bit whirl, etc., may be critical. Rule based decisions may then be made based on such analyses to adaptively and continually adjust the energy term setpoints of one or more slave PD loops controlling the individual G, T and H terms, which in turn may drive the manipulation of adjustable drilling parameters, for example, weight on bit setpoints, RPM setpoints and fluid flow rate setpoints. These adjustable drilling parameter setpoints may be output signals from the slave PID loops passed into the existing PLC network 50 on the drilling rig, thereby continually driving each term G, T and H toward their respective setpoints within preset and adjustable constraints so as to achieve efficient drilling by autonomously delivering the least amount of hydromechanical specific energy required to destroy and remove a given unit volume of rock without sacrificing rate of penetration.

Figure 5:
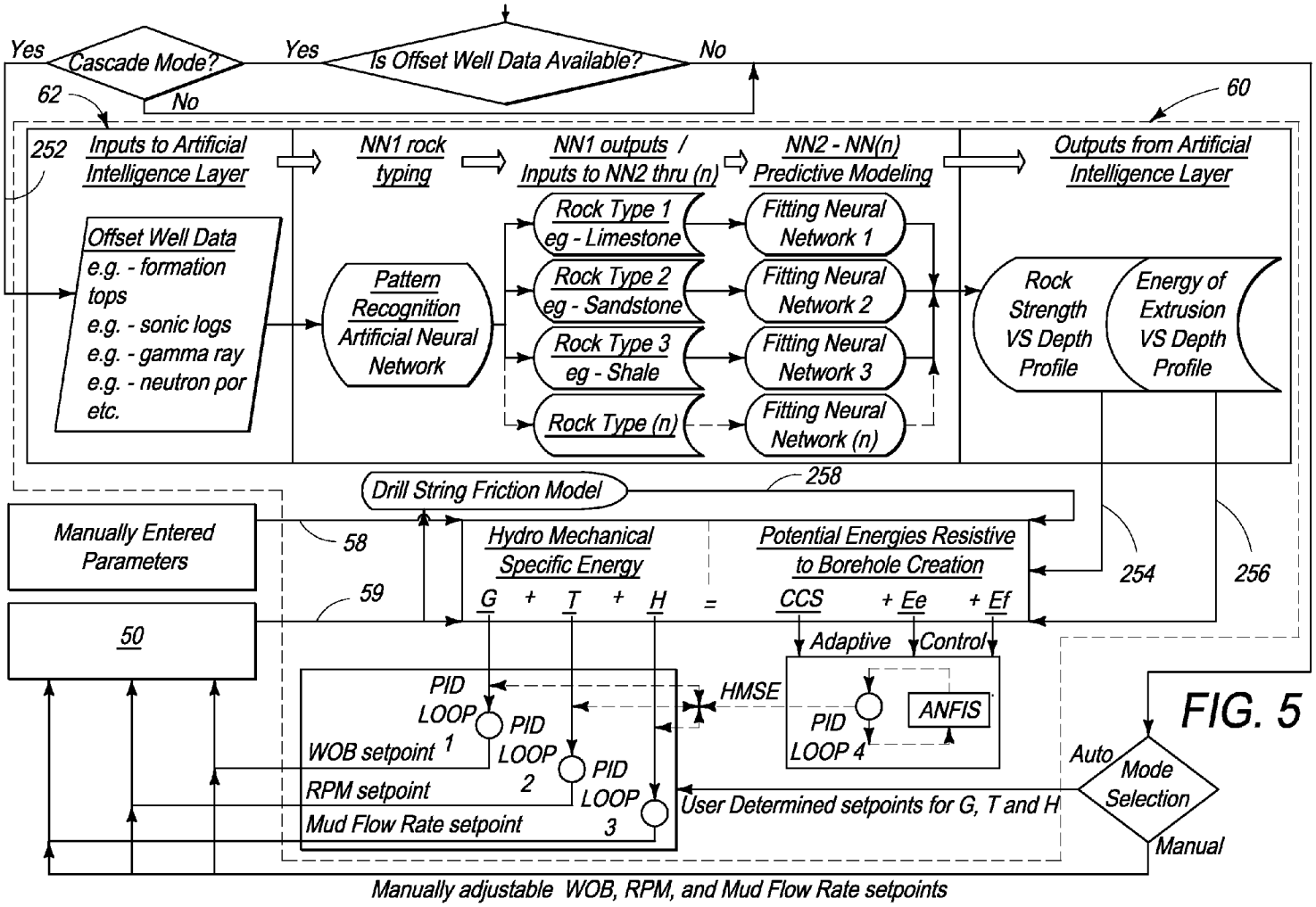
FIG. 5 is a block flow diagram of a further embodiment of the processes of the present invention.

FIG. 5 depicts the embodiments of FIGS. 2-4 in a single schematic so as to illustrate the decision points of the combined process which may be made by operating personnel. The cascade mode of FIG. 4 may only be used where sufficient offset well data is available to provide actual or modeled inputs or combinations thereof into the artificial intelligence layer sufficient to output a rock strength vs. depth profile of the borehole to be drilled 254 and an energy of extrusion vs. depth profile of the borehole to be drilled 256 within acceptable error limits. If insufficient well data exists or if a user determines for some other reason that the cascade mode should not be selected, then the manual mode (also illustrated in FIG. 2) or the automatic mode (also illustrated in FIG. 3) may be selected by a user via any suitable means, such as a graphical user interface.

It will be understood by a skilled artisan that the HMSE calculations and/or predictive modeling performed via artificial intelligence may be performed at a remote location from the drilling rig and may be communicated to the rig control system via an Internet or satellite communication service, which preferably may be secure. Further, calculations of HMSE and the individual terms thereof may be shared with other remotely located personnel, for example in a regional or headquarter office, via a similar communication service.

It will be further understood by a skilled artisan that each of rig's existing control system 50 and advanced control system 60 may include laptop computers, desktop computers, touch screen mobile devices, servers, or other processor-based devices, which in turn may each include a monitor, keyboard, mouse and other user interfaces for interacting with a user and also memory for storing data and other applications, such as hard disk drives, floppy disks, CD-ROMs and other optical media, magnetic tape, and the like.

While the foregoing preferred embodiments of the invention have been described and shown, it is understood that the alternatives and modifications, such as those suggested and others, may be made thereto and fall within the scope of the invention.

I claim:

1. A process for drilling a borehole comprising:

obtaining real-time data necessary to determine a gravitational energy term, a torsional energy term, a hydraulic energy term and a hydromechanical specific energy which is the sum of the gravitational energy term, the torsional energy term and the hydraulic energy term;

determining the gravitational energy term, the torsional energy term, the hydraulic energy term and the hydromechanical specific energy based upon such real-time data, wherein the hydraulic energy term includes a hydraulic energy reduction factor so as to account for the distance between a nozzle of a drill bit and rock and the kinematic viscosity of drilling fluid;

comparing each of the gravitational energy term, the torsional energy term and the hydraulic energy term against a corresponding setpoint for each term; and adjusting at least one drilling parameter based upon the comparison thereby approximating the least amount of energy required to destroy and remove a given unit volume of rock without sacrificing rate of penetration.

2. The process of claim 1 wherein said at least one drilling parameter is weight on bit, rpm, drilling fluid flow rate, or combinations thereof.

3. The process of claim 2 wherein the step of adjusting involves actuation of one or more of draw works, top drive and mud pumps of a drilling rig.

4. The process of claim 3 wherein the step of adjusting involves at least actuation of the mud pumps of a drilling rig.

5. The process of claim 2 wherein said at least one drilling parameter is adjusted manually.

6. The process of claim 1 wherein said steps are performed continually.

7. The process of claim 1 further comprising:

changing at least one of said corresponding setpoints.

8. The process of claim 7 wherein said at least one of said corresponding setpoints is changed to maintain a specified ratio between at least two of said gravitational energy term, said torsional energy term and said hydraulic energy term and thereby controlling the partial contribution of said at least two energy terms to the hydromechanical specific energy.

9. The process of claim 1 wherein said real-time data is obtained from surface equipment, from downhole tools in the borehole, or from both the surface equipment and downhole tools in the borehole.

10. A process for drilling a borehole comprising:

obtaining real-time data necessary to determine a gravitational energy term, a torsional energy term, a hydraulic energy term and a hydromechanical specific energy which is the sum of the gravitational energy term, the torsional energy term and the hydraulic energy term;

determining values for the gravitational energy term, the torsional energy term, the hydraulic energy term and the hydromechanical specific energy based upon such real-time data;

comparing the determined values for each of the gravitational energy term, the torsional energy term and the hydraulic energy term against corresponding setpoints for each of the gravitational energy term, the torsional energy term and the hydraulic energy term; and automatically adjusting at least one drilling parameter based upon the comparison thereby reducing the amount of energy required to destroy and remove a given unit volume of rock without sacrificing rate of penetration.

11. The process of claim 10 wherein said at least one drilling parameter is weight on bit, rpm, drilling fluid flow rate, or combinations thereof.

12. The process of claim 11 wherein the step of adjusting involves actuation of one or more of draw works, top drive and mud pumps of a drilling rig.

13. The process of claim 12 wherein the step of adjusting involves at least actuation of the mud pumps of a drilling rig.

14. The process of claim 10 wherein said steps are performed continually.

15. The process of claim 10 further comprising:

changing at least one of said corresponding setpoints.

16. The process of claim 14 wherein said at least one of said corresponding setpoints is changed to maintain a specified ratio between at least two of said gravitational energy term, said torsional energy term and said hydraulic energy term and thereby controlling the partial contribution of said at least two energy terms to the hydromechanical specific energy.

17. The process of claim 10 wherein said real-time data is obtained from surface equipment, from downhole tools in the borehole, or from both the surface equipment and downhole tools in the borehole.

18. A process for drilling a borehole comprising:

obtaining real-time data necessary to determine a gravitational energy term, a torsional energy term, a hydraulic energy term and a hydromechanical specific energy which is the sum of the gravitational energy term, the torsional energy term and the hydraulic energy term;

determining the gravitational energy term, the torsional energy term, the hydraulic energy term and the hydromechanical specific energy based upon such real-time data;

comparing the hydromechanical specific energy against a quantity of specific energy representing a compressive strength of subterranean rock encountered during drilling, an energy of extrusion for crushed rock particles, and drill string friction encountered in the borehole while drilling; and adjusting at least one drilling parameter based upon the comparison to approximate the least amount of energy required to destroy and remove a given unit volume of rock without sacrificing rate of penetration.

19. The process of claim 18 wherein said at least one drilling parameter is weight on bit, rpm, drilling fluid flow rate, or combinations thereof.

20. The process of claim 19 wherein the step of adjusting involves actuation of one or more of the draw works, top drive and mud pumps of a drilling rig.

21. The process of claim 18 wherein said steps are performed continually.

22. The process of claim 21 wherein said at least one of said corresponding setpoints is changed to maintain a specified ratio between at least two of said gravitational energy term, said torsional energy term and said hydraulic energy term and thereby controlling the partial contribution of said at least two energy terms to the hydromechanical specific energy.

23. The process of claim 18 wherein said real-time data is obtained from surface equipment, from downhole tools in the borehole, or from both the surface equipment and downhole tools in the borehole.

24. The process of claim 18 further comprising:

comparing the determined values for each of the gravitational energy term, the torsional energy term and the hydraulic energy term against a corresponding set points for each of the gravitational energy term, the torsional energy term and the hydraulic energy term; and further adjusting said at least one drilling parameter based upon the comparison to approximate the least amount of energy required to remove a given unit volume of rock.

25. The process of claim 24 wherein said steps are performed continually.

26. The process of claim 24 further comprising:

changing at least one of said corresponding setpoints.

27. The process of claim 26 wherein said at least one of said corresponding setpoints is changed to maintain a specified ratio between at least two of said gravitational energy term, said torsional energy term and said hydraulic energy term and thereby controlling the partial contribution of said at least two energy terms to the hydromechanical specific energy.

28. The process of claim 18 wherein said compressive strength and said particle energy of extrusion are derived from actual well data, modeled well data or combinations thereof.

29. The process of claim 18 wherein said at least one of said corresponding setpoints is changed manually.

30. A system for drilling a borehole comprising:

a drilling rig comprising a drill string having a drill bit secured to one end thereof, draw works for raising and lowering the drill string, a top drive for rotating the drill string and at least one mud pump for circulating drilling fluid through the drill string and the drill bit;

at least one programmable logic controller connected to and controlling at least one of the draw works, the top drive and the at least one mud pump;

a control system which determines a gravitational energy term, a torsional energy term, a hydraulic energy term and a hydromechanical specific energy which is the sum of the gravitational energy term, the torsional energy term and the hydraulic energy term, compares each of the gravitational energy term, the torsional energy term and the hydraulic energy term against a corresponding setpoint for each term, and adjusts at least one drilling parameter based upon the comparison to thereby approximate the least amount of energy required to destroy and remove a given unit volume of rock without sacrificing rate of penetration; and a graphical interface which displays at least the hydromechanical specific energy and permits a user to change said corresponding setpoint manually or automatically by means of the control system.

31. A system for drilling a borehole comprising:

a drilling rig comprising a drill string having a drill bit secured to one end thereof, draw works for raising and lowering the drill string, a top drive for rotating the drill string and at least one mud pump for circulating drilling fluid through the drill string and the drill bit;

at least one programmable logic controller connected to and controlling at least one of the draw works, the top drive and the at least one mud pump;

a control system which determines a gravitational energy term, a torsional energy term, a hydraulic energy term and a value for hydromechanical specific energy which is the sum of the gravitational energy term, the torsional energy term and the hydraulic energy term; compares the value for hydromechanical specific energy against a quantity of specific energy representing the compressive strength of subterranean rock encountered during drilling, an energy of extrusion for crushed rock particles, and the drill string friction encountered in the borehole while drilling; and adjusts at least one drilling parameter based upon the comparison to thereby approximate the least amount of energy required to destroy and remove a given unit volume of rock; and a graphical interface which displays at least the value for hydromechanical specific energy and the quantity of energy representing the compressive strength of subterranean rock encountered during drilling, an energy of extrusion for crushed rock particles, and drill string friction encountered in the borehole while drilling.

* * * * *